US007210663B2

(12) United States Patent
Wheeler et al.

(10) Patent No.: US 7,210,663 B2
(45) Date of Patent: May 1, 2007

(54) TOOL SECURING MECHANISM FOR HANGTAG ASSEMBLY

(75) Inventors: Thomas J. Wheeler, Pomona, CA (US); Zareh Khachatoorian, Northridge, CA (US)

(73) Assignee: JPJ Investment Holding Corporation, Carson City, NV (US)

( * ) Notice: Subject to any disclaimer, the term of this patent is extended or adjusted under 35 U.S.C. 154(b) by 40 days.

(21) Appl. No.: 10/806,027

(22) Filed: Mar. 22, 2004

(65) Prior Publication Data

US 2004/0256530 A1 Dec. 23, 2004

Related U.S. Application Data

(63) Continuation-in-part of application No. 10/463,205, filed on Jun. 17, 2003, now abandoned.

(51) Int. Cl.
*A47F 5/00* (2006.01)

(52) U.S. Cl. ..... 248/309.1; 248/314; 248/317; 248/682; 248/686; 206/349; 211/70.6

(58) Field of Classification Search ..... 248/317, 248/309.1, 314, 682, 686; 206/349; 211/70.6
See application file for complete search history.

(56) References Cited

U.S. PATENT DOCUMENTS 3,354,915 A 11/1967 Johnson (Continued)

FOREIGN PATENT DOCUMENTS

DE 3407122 8/1985

(Continued)

OTHER PUBLICATIONS

U.S. Appl. No. 29/183,299, filed Jun. 10, 2003, Thomas J. Wheeler, et al., "Hangtag."

(Continued)

*Primary Examiner*—A. Joseph Wujciak, III
*Assistant Examiner*—Todd M. Epps
(74) *Attorney, Agent, or Firm*—Edmonds PC; Robb D. Edmonds

(57) ABSTRACT

An apparatus for securing a tool to a hangtag is provided. A method for securing the tool is also provided. In one embodiment, the invention pertains to a hangtag assembly that includes a fastening mechanism for securing a tool having a shank portion, such as a socket driver. The hangtag has a body portion, and a hanging mechanism connected to the body portion. The hangtag also has a tool fastening mechanism for securely attaching a tool to the hangtag. The tool fastening mechanism includes one or more pairs of through-openings, and one or more ties, wherein each tie is wove around the shank of the tool and through a respective pair of through-openings. In another embodiment, the invention pertains to a hangtag assembly that includes a fastening mechanism for securing a circular tool having a centrally located hub portion defining an opening therethrough. The hangtag has a body portion with a plurality of apertures therethrough and a tool fastening mechanism for securely attaching a tool to the hangtag. The tool fastening mechanism includes one or more pairs of openings therethrough. One or more ties, may be woven through the openings of the fastening mechanism, the opening of the tool, and the apertures of the body.

17 Claims, 12 Drawing Sheets

U.S. PATENT DOCUMENTS

| | | | | |
|---|---|---|---|---|
| D227,229 | S | 6/1973 | Funahashi | |
| D249,639 | S | 9/1978 | Hogg et al. | |
| 4,450,961 | A * | 5/1984 | Bies et al. | 206/349 |
| D282,118 | S | 1/1986 | Mengwasser | |
| D297,651 | S | 9/1988 | Merl | |
| D314,984 | S | 2/1991 | Hass | |
| D327,507 | S | 6/1992 | Wahl | |
| 5,129,617 | A | 7/1992 | MacWilliamson | |
| 5,295,422 | A * | 3/1994 | Chow | 81/124.3 |
| D370,174 | S | 5/1996 | Bergstedt | |
| D374,462 | S | 10/1996 | Tyler | |
| 5,728,440 | A | 3/1998 | Good | |
| 5,785,174 | A | 7/1998 | Chow | |
| 5,996,817 | A * | 12/1999 | Kao | 211/70.6 |
| 6,032,797 | A | 3/2000 | Kao | |
| 6,036,064 | A | 3/2000 | Tawil | |
| 6,102,199 | A | 8/2000 | Ho | |
| 6,197,396 | B1 | 3/2001 | Haas | |
| 6,267,152 | B1 | 7/2001 | Doerr | |
| 6,273,255 | B1 | 8/2001 | Rosler | |
| 6,378,700 | B1 | 4/2002 | Tong | |
| 6,409,015 | B1 | 6/2002 | Hu | |
| 6,425,482 | B1 * | 7/2002 | Chiang | 206/349 |
| 6,536,611 | B2 | 3/2003 | Chen | |
| 6,581,894 | B1 | 6/2003 | Tong | |
| 6,634,501 | B2 | 10/2003 | Su | |
| 6,637,591 | B2 * | 10/2003 | Chen | 206/349 |
| 6,672,555 | B2 | 1/2004 | Chang | |
| D486,381 | S * | 2/2004 | Tsai | D8/373 |
| 6,688,955 | B2 * | 2/2004 | Ruey-Zon | 451/360 |
| 6,935,516 | B2 * | 8/2005 | Chiang | 211/70.6 |
| 2003/0029756 | A1 | 2/2003 | Vasudeva | |
| 2003/0070949 | A1 | 4/2003 | Harris et al. | |
| 2004/0099553 | A1 * | 5/2004 | Chen | 206/349 |

FOREIGN PATENT DOCUMENTS

| | | |
|---|---|---|
| EP | 1052184 | 11/2000 |
| FR | 2 706 420 | 12/1994 |

OTHER PUBLICATIONS

U.S. Appl. No. 29/199,555, filed Feb. 17, 2004, Thomas J. Wheeler, et al., "Hangtag."

U.S. Appl. No. 10/458,065, filed Jun. 10, 2003, Thomas J. Wheeler, "Hangtag With Tool Securing Mechanism."

U.S. Appl. No. 10/463,205, filed Jun. 17, 2003, Thomas J. Wheeler, et al., "Tool Securing Mechanism For Hangtag Assembly."

U.S. Appl. No. 10/834,568, filed Apr. 29, 2004, Thomas J. Wheeler, "Hangtag For Multiple Tools."

"Source Tagging Solutions Come From Partnership," Technology News for Loss Prevention and Supply Chain Management Retail News, (Retail News is a publication of Checkpoint Systems, Inc.), vol. 2, 2001, pp. 1-8.

* cited by examiner ( PRIOR ART TOOL )

TOOL SECURING MECHANISM FOR HANGTAG ASSEMBLY

RELATED APPLICATIONS

The present application is a continuation-in-part of utility patent application having Ser. No. 10/463,205, entitled "Tool Securing Mechanism for Hangtag Assembly." That application was filed on Jun. 17, 2003 now abandoned, and is referred to and incorporated herein in its entirety.

BACKGROUND OF THE INVENTION

1. Field of the Invention

The present invention generally relates to tools and tool accessories. The invention more particularly relates to hangtags for supporting and displaying tools. In one aspect, the invention pertains to a hangtag that includes a fastening mechanism for attaching a tool having an elongated shank.

2. Description of the Related Art

In the tool industry, it is desirable to display tools in an organized and presentable manner. One way in which this has been done is through the use of hangtags. Hangtags allow individual tools to be supported and displayed, such as in a retail environment.

FIG. 1 provides a perspective view of an illustrative tool 10 that may be hung from a hangtag assembly. In this exemplary view, the tool 10 is a socket driver. As shown, the socket driver 10 includes a handle portion 12 having a shoulder 13 at one end, an elongated shank 14 protruding from the shoulder 12, and a drive member or "head" 11 disposed at a distal end. Socket drivers 10 are typically configured to fit tightly around and rotate a nut, bolt, or other type of fastener (not shown) in a deep or narrow recess by manually or automatically rotating the socket driver 10. As shown in FIG. 1, the drive member 11 includes a hexagonal opening designed to fit around a bolt or nut of a particular diameter.

It is known to attach a tool to a hangtag as a means of retail display. However, in some instances it is difficult to attach the tool in a secure manner. This is particularly true in the case of tools having an elongated shank, such as screwdriver or such as the socket driver 10 shown in FIG. 1. Therefore, a need exists for a hangtag having a securing or fastening mechanism for securely supporting a tool in such a manner that a large amount of force is required to detach the tool from the hangtag. Difficulty in releasing the tool from the hangtag is desired to decrease the probability of the tool being inadvertently released from the hangtag, and to reduce theft in a retail environment.

There is also a need to shorten the length of currently used hangtags. In this respect, it is necessary to include labeling on the hangtags in order to provide product descriptions, product specifications, and marketing information. This information has typically been placed in an area between the head of the tool and the hanging hole. Thus, a need exists for an offset surface, or "bridge," for placing retail information while conserving the length of material for the hangtag.

SUMMARY OF THE INVENTION

A hangtag assembly is provided for hanging a tool. In one embodiment, a hangtag assembly is provided for hanging a tool having a shank portion. The hangtag assembly first comprises a body portion. The body portion has a front surface and a back surface. A hanging mechanism is operatively connected to the body portion, preferably at an upper end thereof.

The hangtag assembly next comprises a tool fastening mechanism. In one arrangement, the tool fastening mechanism is disposed on a planar surface offset from the front surface of the body portion of the hangtag. The tool fastening mechanism comprises one or more pairs of through-openings. Each pair of through-openings is configured to receive a respective tie.

In operation, the shank of the tool is placed adjacent the tool fastening mechanism of the hangtag assembly. A cable tie is then wrapped around the shank of the tool, and is then run through the through-openings. The tie is then tightened and its ends are fastened. In this manner, the tool is securely affixed to the hangtag assembly.

It is preferred that the tool fastening mechanism include more than one pair of through-openings along the shank of the tool. This prevents the tool from rotationally moving relative to the hangtag. It is also preferred that the cable ties be received within a recess in the planar surface of the hangtag. A label may then be placed over the front of the planar surface to provide a more aesthetic appearance.

In another embodiment, a hangtag assembly for hanging a tool is provided, wherein the tool does not have a shaft. Instead, the tool has an opening in a central portion. The hangtag assembly includes a body with a plurality of apertures therethrough, and a tool fastening mechanism having at least one pair of openings therethrough. The tool is disposed and secured between the fastening mechanism and the hangtag body. A fastener, such as a cable tie, is woven through a pair of the openings on the fastening mechanism, through the central opening of the tool, and then through the apertures in the hangtag body.

A method of hanging a tool from a hangtag assembly is also provided. The method involves providing a hangtag assembly for hanging a tool, wherein the tool does not have a shaft. Instead, the tool has an opening in a central portion. The hangtag assembly includes a body with a plurality of apertures therethrough, and a tool fastening mechanism having at least one pair of openings therethrough. The method further involves placing the opening of the tool between the fastening mechanism and the hangtag body and weaving a fastener, such as a cable tie, through a pair of the openings on the fastening mechanism, through the central opening of the tool, and then through the apertures in the hangtag body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings (FIGS. 2–13). It is to be noted, however, that the appended drawings illustrate only typical embodiments of this invention and are therefore not to be considered limiting of its scope, for the invention may admit to other equally effective embodiments.

A tool fastening mechanism is shown on the hangtag supporting an exemplary socket driver. The socket driver is shown in phantom.

Figure 3:
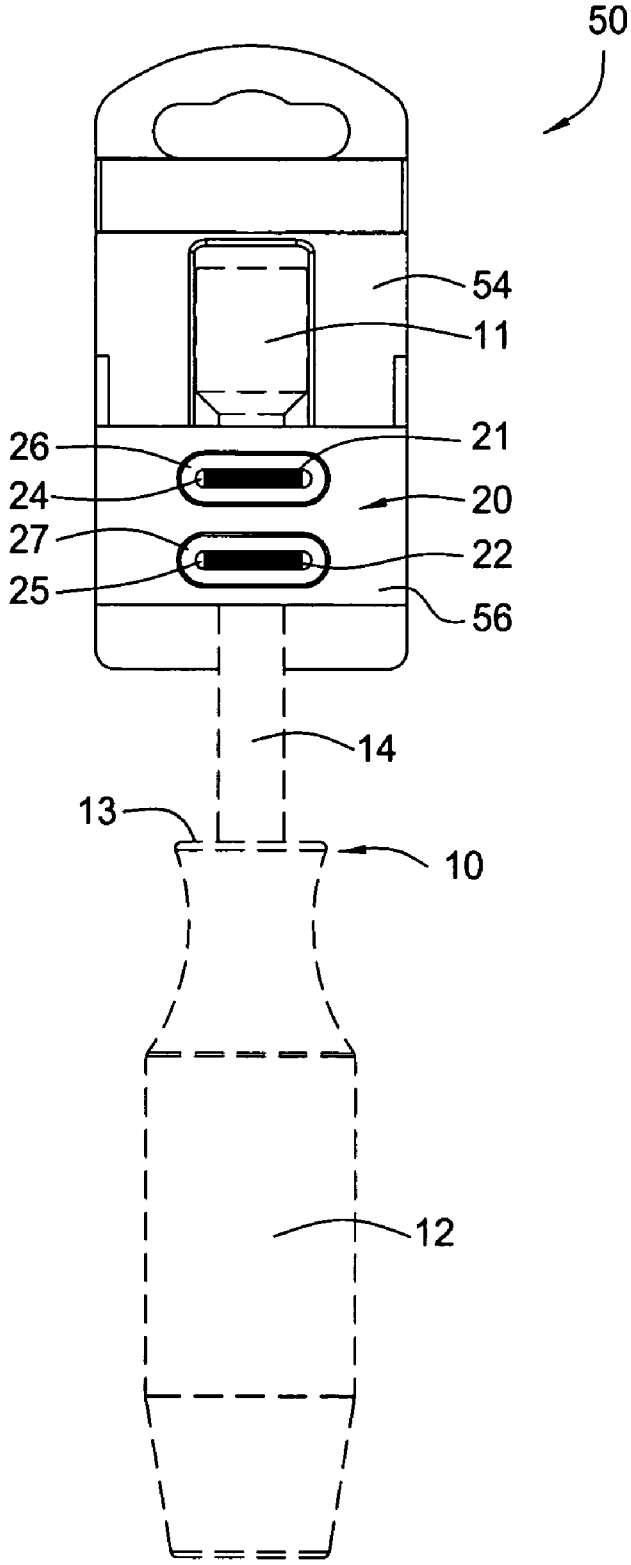

FIG. 3 provides an elevational front view of a hangtag assembly and fastening mechanism according to one embodiment of the present invention. In this view, the socket driver of FIG. 1 is again shown in phantom.

Figure 4:
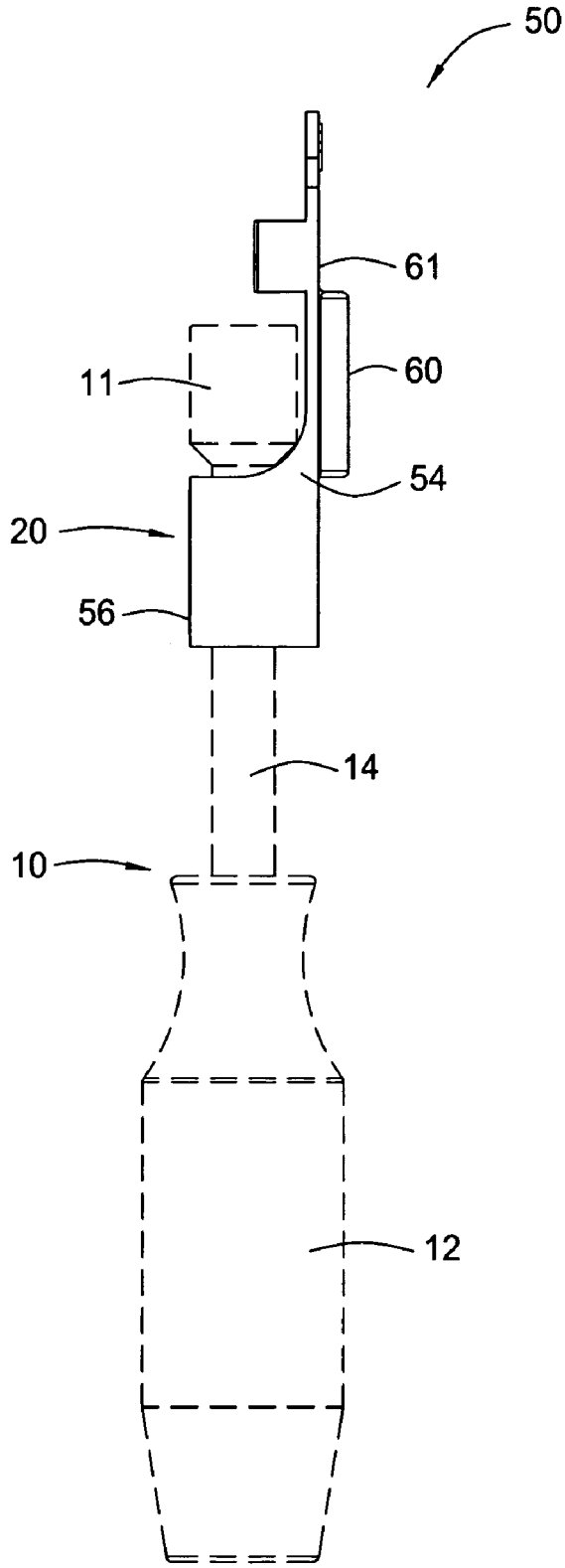
Figure 5:
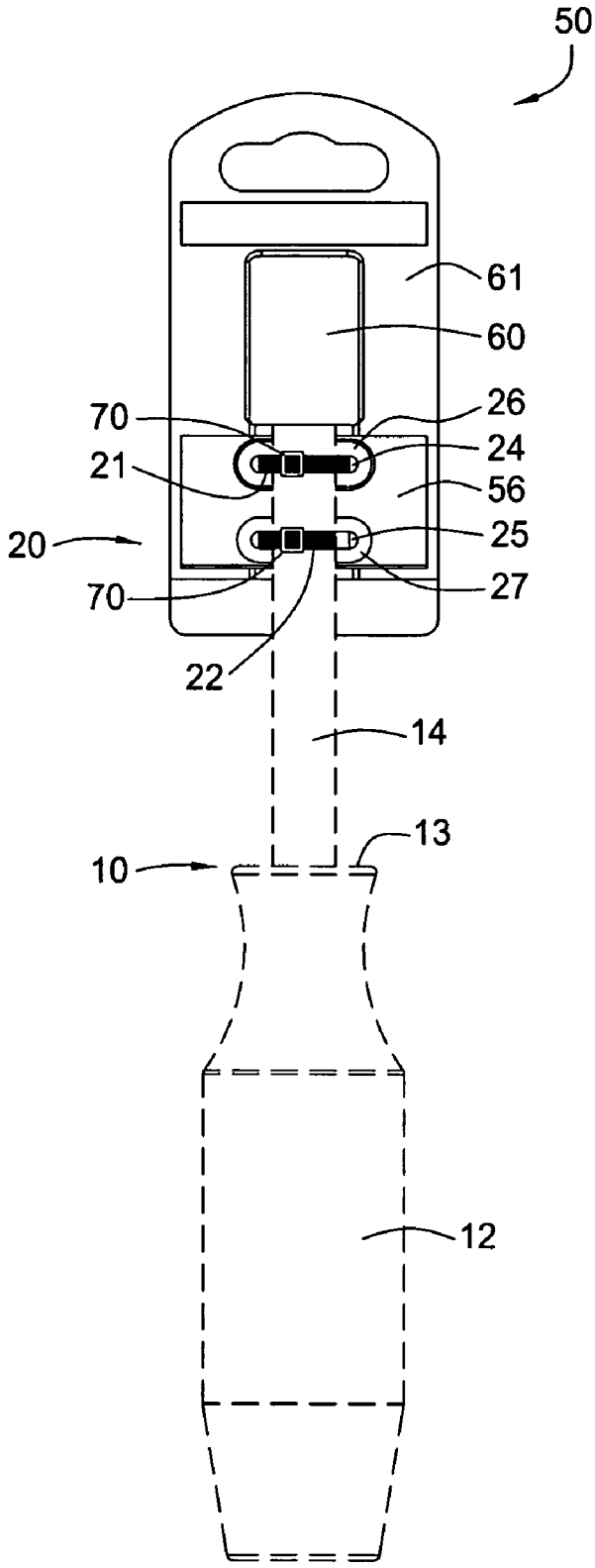

FIG. 4 illustrates an elevational side view of the hangtag and the fastening mechanism of FIG. 3. The socket driver is once again shown in phantom FIG. 5 provides a schematic view of a backside of the hangtag and fastening mechanism of FIG. 3. The socket driver is shown in phantom.

Figure 6:
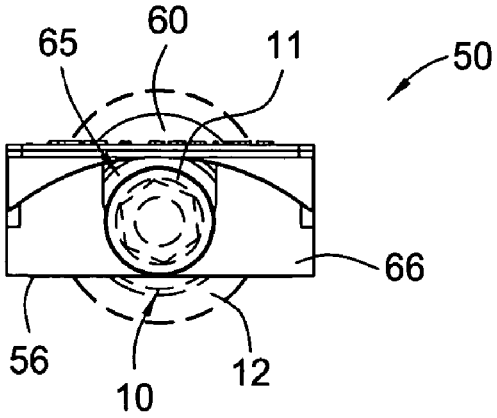

FIG. 6 shows a schematic view of a topside of the hangtag and fastening mechanism of FIG. 3.

Figure 1:
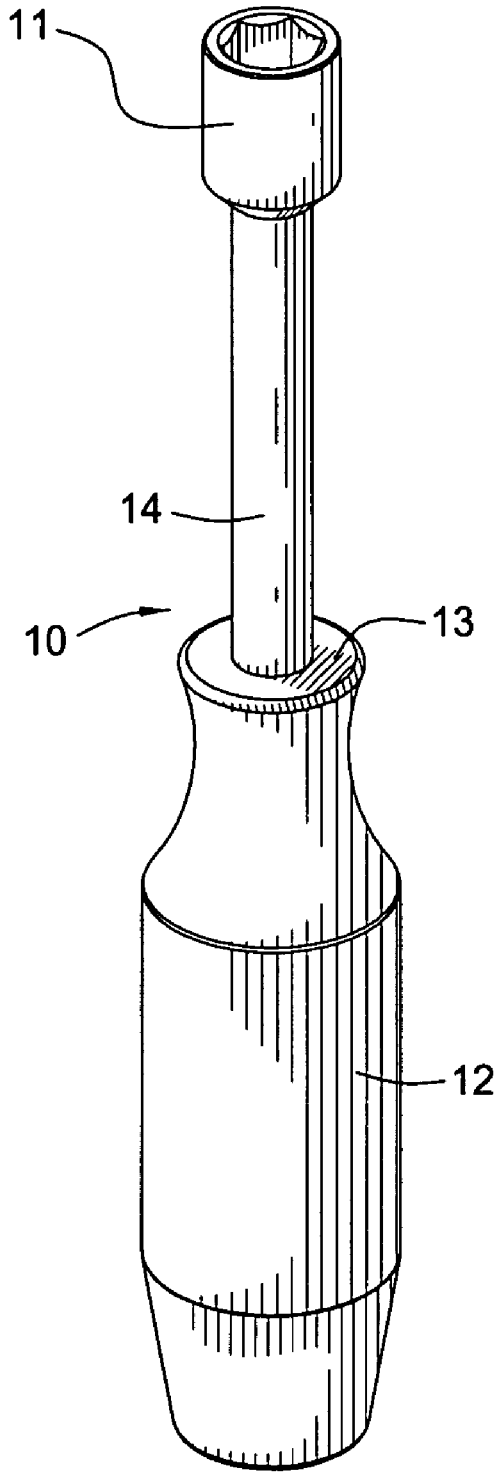
FIG. 1 provides a perspective view of an exemplary tool well known in the tool industry. The tool is a socket driver. The tool includes a handle portion, a head portion, and an elongated shank therebetween.
Figure 7:
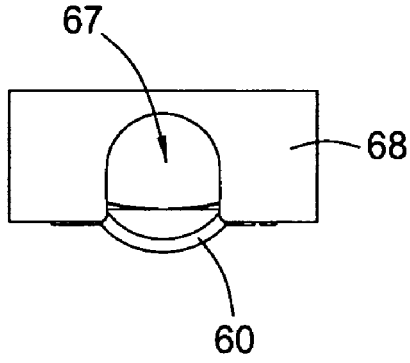

FIG. 7 provides a schematic view of a bottom side of the hangtag of FIG. 3. The socket driver of FIG. 1 is not shown.

Figure 8:
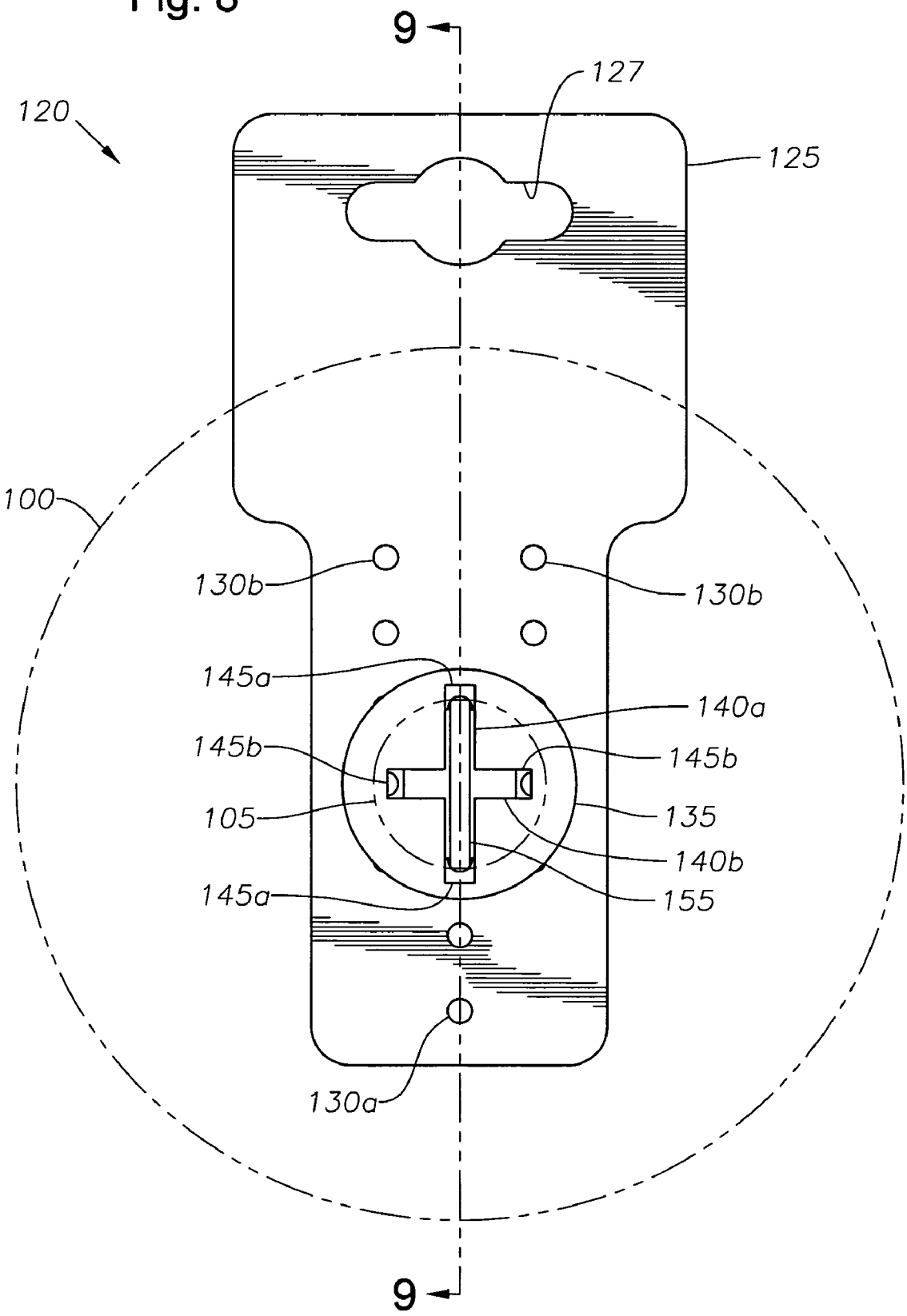

FIG. 8 provides a front view of a hangtag assembly supporting a tool, such as a grinding wheel, according to an alternative embodiment of the present invention. The circular grinding wheel is shown in phantom.

Figure 9:
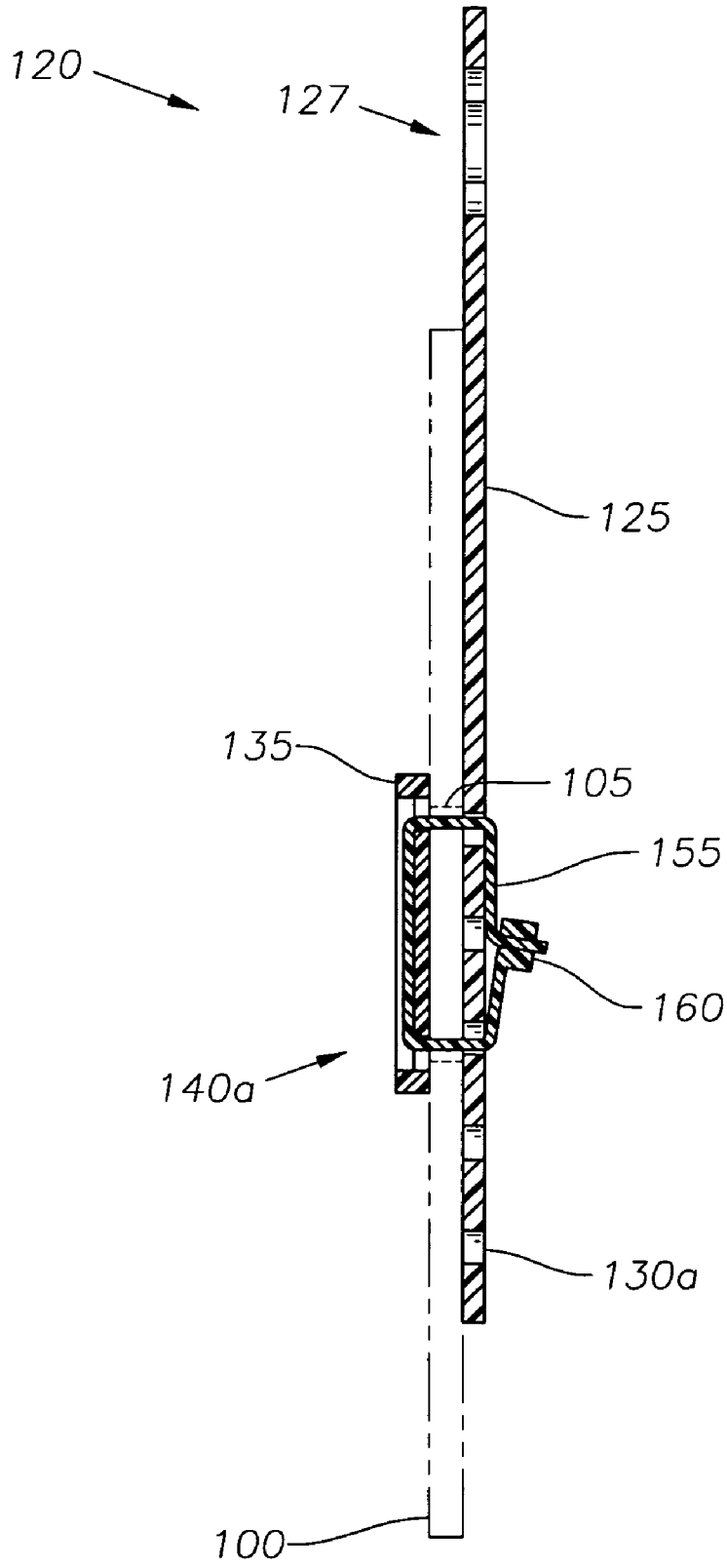

FIG. 9 illustrates a side-sectional view of the hangtag assembly of FIG. 8, taken along line 9—9 of FIG. 8.

Figure 10:
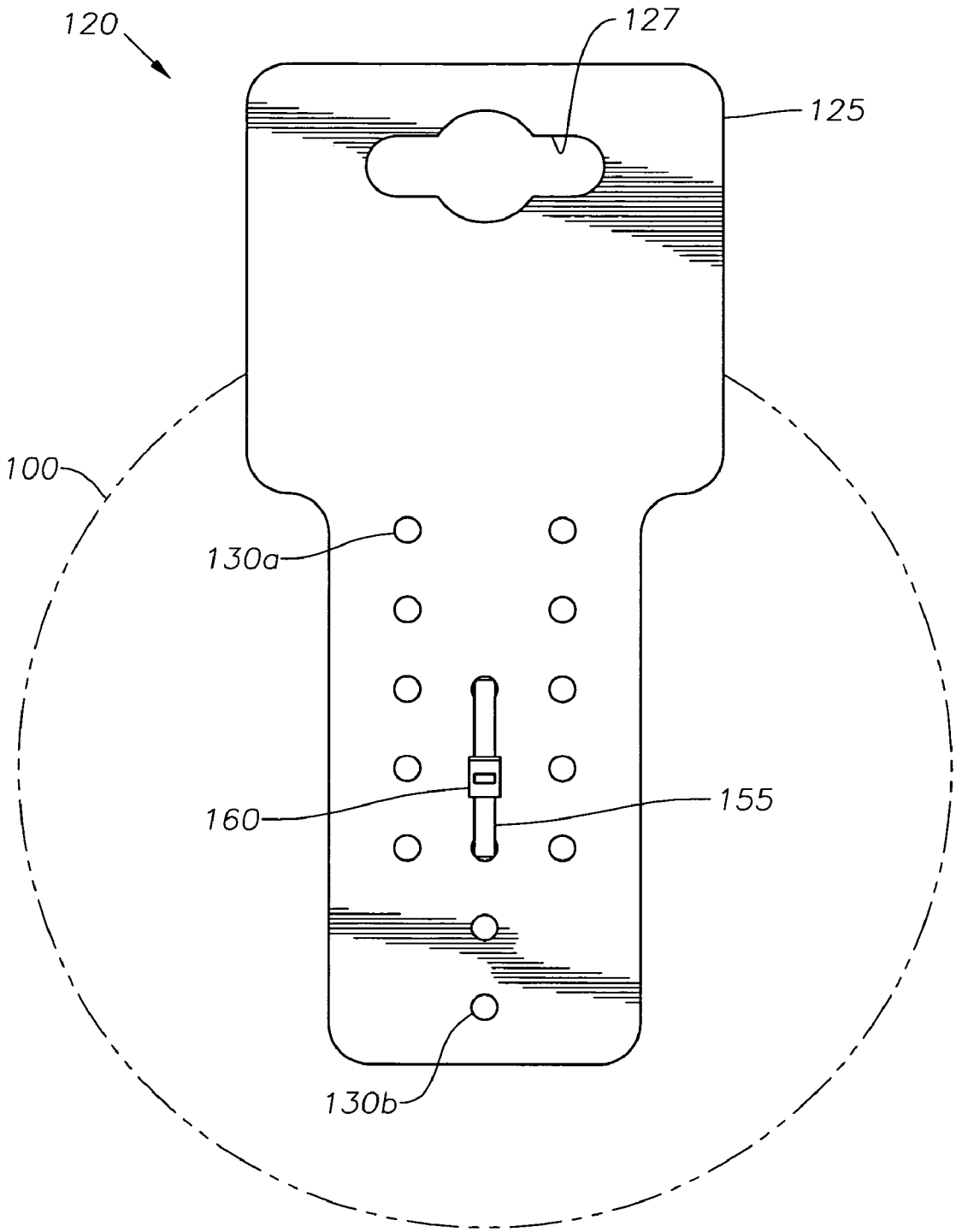

FIG. 10 provides a back view of the hangtag assembly of FIG. 8.

Figure 11:
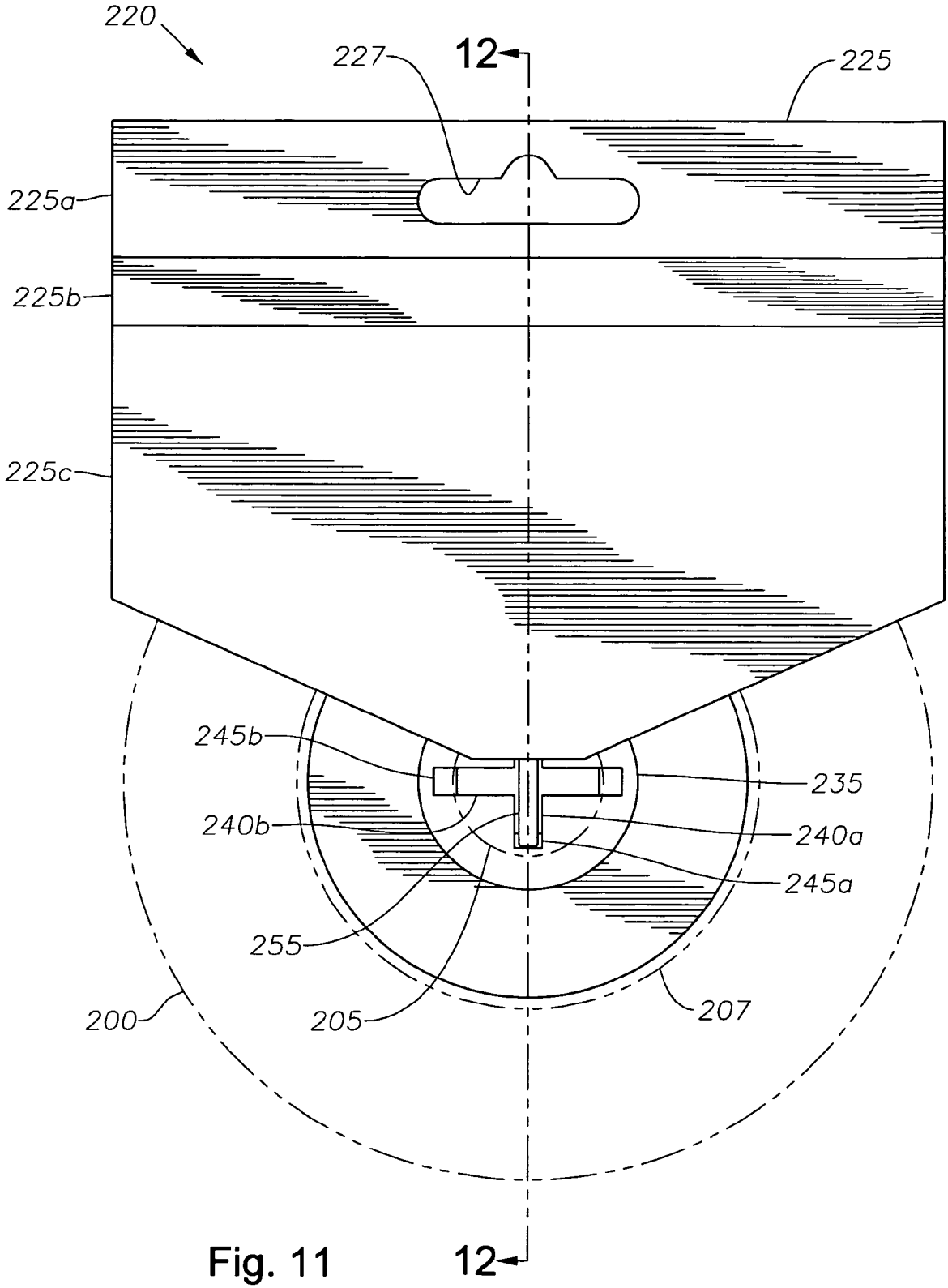

FIG. 11 provides a front view of a hangtag assembly supporting a tool, such as a grinding wheel, according to another alternative embodiment of the present invention. The grinding wheel is shown in phantom.

Figure 12:
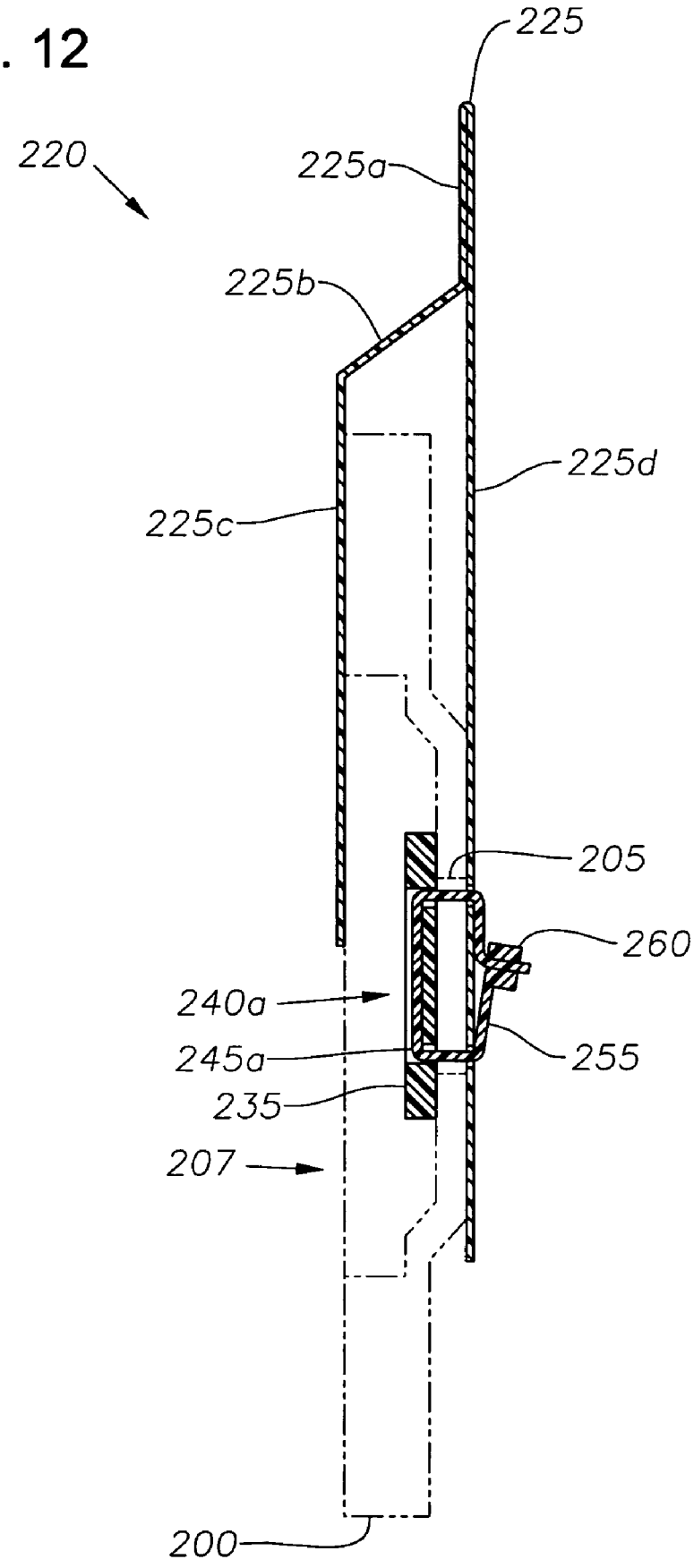

FIG. 12 illustrates a side-sectional view of the hangtag assembly of FIG. 11, taken along line 12—12 of FIG. 11.

Figure 13:
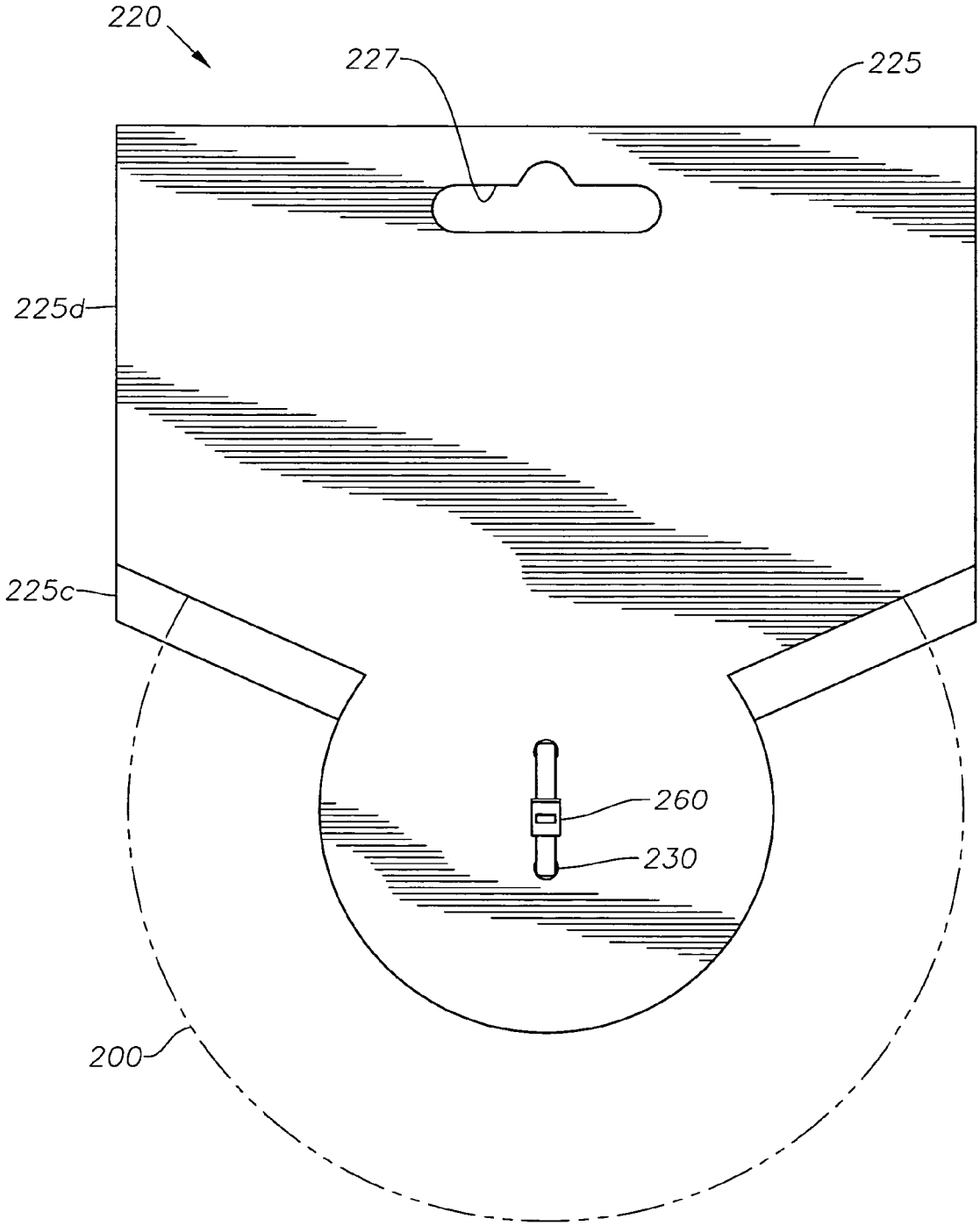

FIG. 13 provides a back view of the hangtag assembly of FIG. 11.

DETAILED DESCRIPTION OF THE PREFERRED EMBODIMENT

Embodiments of the present invention generally relate to an apparatus for supporting a tool, such as socket driver 10 from FIG. 1, a grinding wheel 100 from FIG. 8, or a grinding wheel 200 from FIG. 10, on hangtag assemblies 50, 120, and 220, respectively. Embodiments of the present invention further relate to a hangtag having a fastening mechanism for temporarily securing a tool.

Figure 2:
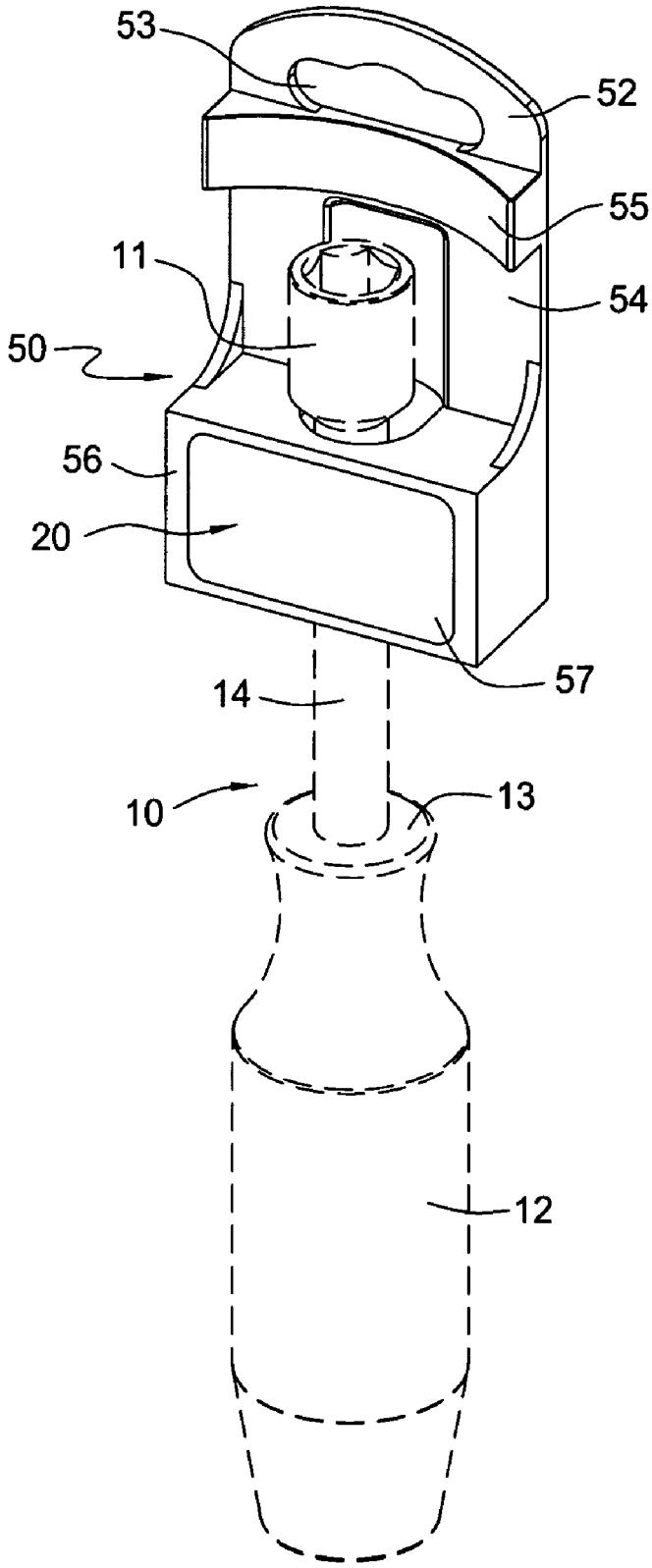
FIG. 2 presents a perspective frontal view of a hangtag as might be used to support and display a single tool product.

FIG. 2 presents a perspective frontal view of a hangtag 50 that can be used to support and display a single tool product. The socket driver 10 from FIG. 1 is shown in phantom as the tool product. It is understood that the tool 10 is demonstrative, and that any tool having an elongated shank 14 may be supported by the hangtag 50 of the present invention. Another example would be a screwdriver (not shown).

The hangtag 50 first comprises a main body 54. The body 54 is generally planar, but optionally includes an upper portion 55 for displaying a first label. A concave geometry for the upper portion 55 provides an attractive, ornamental labeling surface. Typically, the label on the concave surface 55 will present the house mark under which the tool product is sold.

The body 54 optionally also comprises a planar surface 56 that is offset from the body 54. In one arrangement, the offset planar surface 56 defines a lower labeling portion 56. In the embodiment shown in FIG. 2, the lower labeling surface 56 is offset a particular distance from the body 54 and is substantially parallel to the body 54. This provides an aesthetically pleasing three-dimensional effect. The lower labeling portion 56 allows a label 57 describing the product 10 itself to be affixed in an ornamental and pleasing manner. Furthermore, placing a label 57 on the lower labeling portion 56 can serve to conceal a tool securing mechanism 20 disposed along the hangtag 50, as will be described further below.

In the exemplary hangtag 50 of FIG. 2, the product 10 is a socket driver. The socket driver 10 is supported by a tool fastening mechanism (at 20 in FIGS. 3 and 5). The tool fastening mechanism 20 allows the tool 10 to be securely held to the hangtag 50 in a retail environment, but to be detached from the hangtag 50 once the tool 10 has been purchased by a customer.

At the top of the body 54, a hanging mechanism 52 is provided. The hanging mechanism 52 includes a through-opening 53 for receiving a hook or peg (not shown). The hook, in turn, is configured to be attached to a display panel (also not shown). In practice, a number of hooks (or other display pegs) are disposed along a display panel, permitting various hangtags 50 supporting various products 10 to be presented to the customer in a retail environment.

FIG. 3 provides an elevational view of a front side of a hangtag assembly 50 and fastening mechanism 20 according to one embodiment of the present invention. The tool 10 is again shown in phantom. The fastening mechanism 20 is disposed at a lower portion of the hangtag assembly 50. As shown in FIG. 3, the fastening mechanism 20 is designed to firmly secure a socket driver 10. However, it is again understood that other tools with a shank, such as a screwdriver or a wrench, can be adequately secured by the fastening mechanism 20 according to the present invention. Preferably, tools having an elongated shank with a head and a shoulder disposed at opposing ends of the shank, wherein the head and the shoulder have a larger diameter or width than the shank diameter or width, can be ideally fastened using the present invention. This configuration of the tool 10 having a shank 14, a driver head 11, and a shoulder 13, as shown in FIG. 3, enhances the securing capabilities of the tool 10 by providing a blockade at each end of the shank, thereby preventing the tool from being forcibly pulled out from the fastening mechanism 20 by overcoming the frictional forces provided by the fastening mechanism 20.

It should also be noted at this point that, for purposes of the present disclosure, the term "shank" includes any intermediate portion of a tool between a handle portion and a head member. By way of additional example, and not limitation, the shank may include the intermediate portions of groove joint pliers or channel locks (not shown) between the two handles and the respective gripping heads.

Referring again to FIG. 3, the label 57 placed on the lower labeling surface 56 has been removed so as to illustrate in more detail the fastening mechanism 20. The fastening mechanism 20 comprises at least one recess 26. In the arrangement of FIG. 3, the fastening mechanism 20 comprises an upper horizontal recess 26 and a lower horizontal recess 27 disposed on the lower labeling surface 56. Each recess 26, 27 includes a pair of through-openings 24 and 25, respectively. The through-openings 24, 25 allow a fastener, such as a cable tie or "zip" tie, to be disposed through each opening and fastened around a tool 10 behind the lower labeling surface 56. Although two cable ties 21, 22 are shown in FIG. 3, it is understood that any number of cable ties and recesses with opposed through-openings including only one can be used in the fastening mechanism 20 to secure a tool 10 to the hangtag 50. The respective fasteners 21, 22 provide the necessary frictional force to the shank 14 of the tool 10 to firmly secure the tool 10 in position within the hangtag 50.

FIG. 4 provides a side elevational view of the hangtag assembly 50. The socket driver 10 is again shown in phantom as attached to the hangtag 50. As shown in FIG. 4, the hangtag body 54 includes a recessed portion 60 protruding from the backside 61 of the hangtag assembly 50. The recessed portion 60 is designed to allow the head 11 of the tool 10 to be received within the hangtag assembly 50. The recessed portion 60 also allows the head 11 of the tool 10 to be adjusted axially without chafing the hangtag body 54, thereby preventing damage to the hangtag body 54.

FIG. 5 provides an elevational view of the backside of the hangtag assembly 50 and fastening mechanism 20, with the attached tool 10 again shown in phantom. As shown in FIG. 5, the two fasteners 21, 22 are disposed around the shank 14 of the tool 10, thereby securing the tool 10 to the hangtag assembly 50 through the pair of through-openings 24, 25. Two cable ties 21, 22 are shown zipped through the respective through-openings 24, 25, which are, as previously described, disposed on the offset, lower labeling surface 56. Each cable tie 21, 22 includes a retaining member 70. The retaining member 70 allows each cable tie 21, 22 to be shortened to a particular size and to retain that size, thereby preventing the cable ties 21, 22 from loosening during the time period that the tool 10 is attached to the hangtag assembly 50. Excess length of the cable ties 21, 22 may optionally be cut.

Although only one cable tie is required to fasten the tool 10 to the hangtag 50, it is advantageous to incorporate two or more cable ties into the fastening mechanism 20. Having two or more cable ties prevents the tool 10 from pivoting away from the backside of the lower labeling surface 56. Accordingly, having two or more cable ties will enhance the fastening mechanism's 20 ability to retain a tool in a desired position.

FIG. 6 illustrates a top view of the hangtag assembly 50. The tool 10 is again shown in phantom. The hexagonal opening on the driver head 11 is more clearly shown in FIG. 6. As shown in FIG. 6, the driver head 11 is disposed between the recessed portion 60 and the lower labeling portion 56. The lower labeling portion 56 includes a first planar portion 66 having an arcuate through-opening 65 designed to receive the driver head 11. The through-opening 65 has a curved profile formed by the first planar portion 66 and the lower edge of the recessed portion 60.

FIG. 7 provides a bottom view of the hangtag assembly 50. The tool 10 is not shown in FIG. 7. The lower labeling portion 56 also includes a second planar portion 68. As in the first planar portion 66, the second planar portion 68 includes a curved through-opening 67 designed to receive the tool 10. The through-opening 67 is shown as having an open end on the edge of the second planar portion 68. The open edge allows a tool 10 having a head 11 with larger diameter than its shank 14 to be inserted into the hangtag assembly 50. The size of the arcuate portion 60 that protrudes from the backside 61 of the hangtag 50 and the size of the through-openings 65, 67 are configured specifically to receive the particular tool 10 desired for attachment to the hangtag 50.

In operation, the shank 14 of a tool, e.g., tool 10, is placed adjacent the tool fastening mechanism 20 of a hangtag assembly 50. Fasteners, such as cable ties 21, 22, are then wrapped around the shank 14 of the tool 10, and are wove through the opposing respective through-openings 24, 25. The ties 21, 22 are then tightened and the ends are fastened. In this manner, the tool 10 is securely affixed to the hangtag assembly 50.

It is preferred that the cable ties 21, 22 be received within respective recesses 26, 27 in a planar surface of the hangtag 50. A label 57 may then be placed over the front of the planar surface 56 to provide a more aesthetic appearance.

FIGS. 8 and 10 provide front and back views, respectively, of a hangtag assembly 120 supporting a tool, such as a grinding wheel 100, according to an alternative embodiment of the present invention. The grinding wheel 100 is shown in phantom. FIG. 9 illustrates a side-sectional view taken along line 9—9 of FIG. 8. As shown, the grinding wheel 100 includes a hub portion defining a central opening 105 therethrough. It is understood that the tool 100 is demonstrative, and that any tool having an opening proximate its center may be supported by the hangtag 120.

The hangtag 120 first comprises a main body 125. The body 125 is generally planar. Preferably, the main body 125 is constructed of plastic. However, it may be also constructed from cardboard or other material of sufficient resilience for supporting the weight of the tool 100. Near a top of the body 125, a through-opening 127 is provided for receiving a hook (not shown). The hook, in turn, is configured to be attached to a display panel (also not shown). In practice, a number of hooks are disposed along a display panel, permitting various hangtags 120 supporting various products 100 to be presented to the customer in a retail environment.

The grinding wheel 100 is supported by a tool fastening mechanism 135. The tool fastening mechanism 135 allows the tool 100 to be securely held to the hangtag 120 in a retail environment, but to be detached from the hangtag 120 once the tool 100 has been purchased by a customer. As shown, the fastening mechanism 135 is circular in shape, however, the shape of the fastening mechanism is not essential to the invention. Preferably, the fastening mechanism 135 is constructed of plastic and serves as a plate that is placed adjacent the central opening 105 of the tool 100 opposite the body 125 of the hangtag 120.

The fastening mechanism 135 is configured to have an outside diameter greater than that of the central opening 105. The fastening mechanism 135 comprises at least one linear recess 140 configured to receive a fastener 155, such as a cable tie; however, the recess may be omitted. As shown, the fastening mechanism 135 employs both a vertical recess 140*a* and a horizontal recess 140*b*. Each recess 140*a,b* includes a pair of through-openings 145*a,b*, respectively. Having two recesses 140*a,b* allows for the placement of two cable ties. However, in the illustrative arrangement of FIG. 8, only a single fastener 155 is employed.

Disposed through a lower portion of the main body 125 are two sets of apertures 130*a,b*. As shown, each set comprises more than two apertures. This allows the position of the fastening mechanism 135 to be adjusted along the body 125. The cable tie or "zip" tie 155 is woven through each opening 145*a*, the opening 105 of the tool 100, and apertures 130 to fasten the tool 100 to the hangtag 120. The cable tie 155 includes a retaining member 160. The retaining member 160 allows the cable tie to be shortened to a particular size and to retain that size, thereby preventing the cable tie from loosening during the time period that the tool 100 is attached to the hangtag assembly 120. Excess length of the cable tie 155 may optionally be cut.

In operation, the central opening 105 of a tool, e.g., tool 100, is placed between the tool fastening mechanism 135 and the body 125 of the hangtag assembly 120. The cable tie 155 is then woven through one pair (as shown) of openings 145*a* in the fastening mechanism 135, through the central opening 105, and then through the selected pair (as shown) of apertures 130*a* in the hangtag body 125. The tie 155 is then tightened and the ends fastened so that the tie is disposed along recess 140*a* (as shown). Optionally, a second cable tie may be added in a similar fashion. In this manner, the tool 100 is securely affixed to the hangtag assembly 120.

FIGS. 11 and 13 provide front and back views, respectively, of a hangtag assembly 220 supporting a tool, such as a grinding wheel 200, according to another alternative embodiment of the present invention. The grinding wheel 200 is shown in phantom. FIG. 12 illustrates a side-sectional view taken along line 12—12 of FIG. 11. As shown, the grinding wheel 200 includes a first hub portion defining a cavity 207 in which a second hub portion, defining a central opening 205 therethrough, is located. It is understood that the tool 200 is demonstrative, and that any tool, such as the tool 100 shown in FIGS. 8–10, having an opening proximate its center may be supported by the hangtag 220.

The hangtag 220 first comprises a main body 225. The body 225 is generally planar having a front side with portions 225*a*–*c* and a backside 225*d*. Portion 225*a* is flush with the back portion 225*d*. Portion 225*b* extends away from portion 225*a* so that portion 225*c* may cover a portion of the tool 200. Preferably, labels (not shown) are disposed on portions 225*a,c,d*; however, portion 225*b* may also serve as a labeling surface. Preferably, the main body 225 is constructed of cardboard. However, it may be also constructed from plastic or other desirable but economical material.

At the top of the body 225, a through-opening 227 is provided for receiving a hook or other display peg. The hook, in turn, is configured to be attached to a display panel (also not shown). In practice, a number of hooks are disposed along a display panel, permitting various hangtags 220 supporting various products 200 to be presented to the customer in a retail environment.

The grinding wheel 200 is supported by a tool fastening mechanism 235. The tool fastening mechanism 235 allows the tool 200 to be securely held to the hangtag 220 in a retail environment, but to be detached from the hangtag 220 once the tool 200 has been purchased by a customer. As shown, the fastening mechanism 235 is circular in shape, however, the shape of the fastening mechanism is not essential to the invention. Preferably, the fastening mechanism 235 is constructed of plastic and serves as a plate that is placed adjacent the central opening 205 of the tool 200 opposite the body 225 of the hangtag 220.

The fastening mechanism 235 is configured to have an outside diameter greater than that of the tool hole 205. The fastening mechanism 235 comprises at least one linear recess 240 configured to receive a fastener 255, such as a cable tie; however, the recess may be omitted. As shown, the fastening mechanism 235 employs both a vertical recess 240*a* and a horizontal recess 240*b*. Each recess 240*a,b* includes a pair of through-openings 245*a,b*, respectively. Having two recesses 240*a,b* allows for the placement of two cable ties. However, in the illustrative arrangement of FIG. 11, only a single fastener 155 is employed.

Disposed through the back portion 225*d* of the main body 225 are apertures 230 for receiving the fastener 255. The cable tie or "zip" tie 255 is woven through each opening 245*a*, the opening 205 of the tool 200, and apertures 230 to fasten the tool 200 to the hangtag 220. The cable tie 255 includes a retaining member 260. The retaining member 260 allows the cable tie to be shortened to a particular size and to retain that size, thereby preventing the cable tie from loosening during the time period that the tool 200 is attached to the hangtag assembly 220. Excess length of the cable tie 255 may optionally be cut.

In operation, the central opening 205 of a tool, e.g., tool 200, is placed between the tool fastening mechanism 235 and backside 225*d* of the body 225 of the hangtag assembly 220. The cable tie 255 is then woven through one pair (as shown) of openings 245*a* in the fastening mechanism 235, through the central opening 105, and then through the apertures 230. The tie 255 is then tightened and the ends fastened so that the tie is disposed along recess 240*a* (as shown). Optionally, a second fastener may be added in a similar fashion by adding more apertures in the backside 225*d*. In this manner, the tool 200 is securely affixed to the hangtag assembly 220.

While the foregoing is directed to embodiments of the present invention, other and further embodiments of the invention may be devised without departing from the basic scope thereof, and the scope thereof is determined by the claims that follow.

The invention claimed is:

1. A hangtag assembly hanging a tool, the hangtag assembly comprising:
- a body, the body comprising:
  - a planar portion, and
  - a fastening mechanism, the fastening mechanism, comprising:
    - a planar surface offset from the planar portion for receiving a head of the tool between the surface and the portion,
    - a recess formed in the surface,
    - a pair of openings disposed through the fastening mechanism, wherein the pair of openings is disposed in the recess, and
    - a cable tie, wherein the cable tie is a physically separate piece relative to the body and disposed through the pair of openings and in the recess so that the cable tie is behind the planar surface, wherein the tool has the head and a shank, wherein the shank is disposed between the planar portion and the planar surface and the cable tie is tight around the shank, and wherein the fastening mechanism further comprises a second recess formed in the planar surface and a second pair of openings disposed through the fastening mechanism and in the second recess and the hangtap assembly further comprises a second cable tie disposed through the second pair of openings and in the recess so that the cable tie is behind the surface and tight around the shank.

2. The hangtag assembly of claim 1, wherein the planar portion comprises a hole therethrough for receiving a hook.

3. The hangtag assembly of claim 1, wherein the planar portion comprises a concave portion.

4. The hangtag assembly of claim 3, further comprising a label disposed on the concave portion.

5. The hangtag assembly of claim 1, further comprising a label disposed on the planar surface, the label concealing the recess, the openings, and the cable tie.

6. The hangtag assembly of claim 1, wherein the tool is a socket driver, a wrench, pliers, or channel locks.

7. The hangtag assembly of claim 1, wherein the planar portion comprises a recessed portion having a length substantially equal to a length of the head.

8. The hangtag assembly of claim 1, wherein the head of the tool is exposed.

9. The hangtag assembly of claim 8, wherein the tool further comprises a handle, and wherein the handle and a portion of the shank are exposed.

10. The hangtag assembly of claim 1, wherein the planar portion is substantially parallel to the planar surface.

11. A hangtag assembly hanging a tool, wherein the tool has an opening therehtrough, the opening having a diameter the hangtags assembly comprising:

a body with a pair of apertures therethrough, the body having a dimension greater than the diameter of the opening;

a fastening mechanism having a dimension greater than the diameter of the opening, the fastening mechanism comprising a pair of holes disposed therethrough, wherein the tool is disposed between the body and the fastening mechanism;

a cable tie disposed through the holes, the opening, and the apertures, wherein the cable tie is tight, thereby securing the fastening mechanism, the tool, and the body together; and wherein the fastening mechanism further comprises a second recess formed in the surface and a second pair of holes disposed therethrough and in the second recess, the body further comprises a second pair of apertures disposed therethrough, and the hangtag assembly further comprises a second cable tie disposed through the second pair of holes, the opening, and the second pair of apertures, wherein the second cable tie is tight, thereby securing the fastening mechanism, the tool, and the body together.

12. The hangtag assembly of claim 11, wherein the body further comprises a front portion and a back portion, the front portion covering at least a portion of the tool and for displaying a label thereon and the pair of apertures are disposed through the back portion.

13. The hangtag assembly of claim 11, wherein the body further comprises a second pair of apertures so that the position of the cable tie and the tool relative to the body may be adjusted.

14. The hangtag assembly of claim 11, wherein the fastening mechanism further comprises a surface and a recess formed in the surface, wherein the holes are disposed in the recess and the cable tie is disposed in the recess so that the cable tie is behind the surface.

15. The hangtag assembly of claim 11, wherein the body is constructed of plastic or cardboard and the fastening mechanism is constructed of plastic.

16. The hangtag assembly of claim 11, wherein the tool further comprises a cavity disposed partially therethrough, the opening is disposed in the cavity, and the fastening mechanism is entirely disposed in the cavity.

17. The hangtag assembly of claim 11, wherein the tool is a grinding wheel.

* * * * *